United States Patent [19]

Kurematsu et al.

[11] Patent Number: 4,863,837

[45] Date of Patent: Sep. 5, 1989

[54] METHOD OF PROCESSING LIGHT-SENSITIVE SILVER HALIDE COLOR PHOTOGRAPHIC MATERIAL COMPRISING COMBINATIONS OF TWO DIFFERENT SEQUESTERING AGENTS AND A SENSITIZING DYE

[75] Inventors: Masayuki Kurematsu; Shigeharu Koboshi, both of Hino, Japan

[73] Assignee: Konishiroku Photo Industry Co., Ltd., Tokyo, Japan

[21] Appl. No.: 149,966

[22] Filed: Feb. 2, 1988

Related U.S. Application Data

[63] Continuation of Ser. No. 841,445, Mar. 19, 1986, abandoned.

[30] Foreign Application Priority Data

Mar. 29, 1985 [JP] Japan ..... 60-67343

[51] Int. Cl.[4] ..... G03C 7/30

[52] U.S. Cl. ..... 430/372; 430/429; 430/463; 430/491

[58] Field of Search ..... 430/372, 491, 463, 428, 430/429

[56] References Cited

U.S. PATENT DOCUMENTS 3,582,347 7/1968 Holly, Jr. et al. ..... 430/375

3,997,348 12/1976 Shimamura et al. ..... 430/372

OTHER PUBLICATIONS

Research Disclosure, No. 175, Nov. 1978, p. 45, Abstract No. 17549, Industrial Opportunities, Havant, Hampshire, GB; T. J. Kelly: "Stabilizing Baths for Use in Photographic Processing".

*Primary Examiner*—Richard L. Schilling

*Attorney, Agent, or Firm*—Frishauf, Holtz, Goodman & Woodward

[57] ABSTRACT

In a method of processing a light-sensitive silver halide color photographic material, comprising color developing a light-sensitive silver halide color photographic material and thereafter processing it with a processing solution having fixing ability, followed by processing with a water-washing substitute stabilizing solution in a processing tank or tanks comprising 1 to 4 tanks, the improvement wherein said water-washing substitute stabilizing solution contains at least one of the compounds represented by Formula (I) shown below and at least one of nitrilotriacetic acid and the compounds represented by Formula (II) shown below and wherein said light-sensitive silver halide color photographic material is sensitized with at least one sensitizing dye represented by Formula (III) or Formula (IV) shown below:

Formula (I)

wherein R represents a hydrogen atom or an alkyl group having 1 to 5 carbon atoms, and M represents a hydrogen atom or an alkali metal atom;

Formula (II)

wherein A represents a carboxyl group or a hydroxymethyl group; D represents an alkylene group having 2 to 4 carbon atoms and having or not having a hydroxyl group, a cyclohexene group, a group of a group of $-C_2H_4OC_2H_4OC_2H_4-$; and M represents a hydrogen atom, an alkali metal atom or an ammonium group;

Formula (III)

wherein $Z^1$ and $Z^2$ each represent an atomic group necessary for formation of a benzothiazole nucleus, a naphthoxazole nucleus, a benzothiazole nucleus, a naphthothiazole nucleus, a benzocelenazole nucleus, a naphthocelenazole nucleus, a benzoimidazole nucleus, a naphthoimidazole nucleus, a pyridine nucleus or a quinoline nucleus; $R^1$ and $R^2$ each represents a group selected from an alkyl group, an alkenyl group and aryl group; $R^3$ represents a hydrogen atom, a methyl group or an ethyl group; $X^{1-}$ represents an anion, and is 0 or 1; and wherein $Z^3$ and $Z^4$ each represent an atomic group necessary for formation of a benzene ring or a naphthalene ring condensed at an oxazole ring or a thiazole ring, and $A^1$ and $A^2$ are each oxygen or sulfur.

18 Claims, No Drawings

METHOD OF PROCESSING LIGHT-SENSITIVE SILVER HALIDE COLOR PHOTOGRAPHIC MATERIAL COMPRISING COMBINATIONS OF TWO DIFFERENT SEQUESTERING AGENTS AND A SENSITIZING DYE

This is a continuation of application Ser. No. 841,445, filed Mar. 19, 1986, now abandoned.

BACKGROUND OF THE INVENTION

This invention relates to a method of processing a light-sensitive silver halide color photographic material (hereinafter referred to as "light-sensitive material"), in which a water-washing step has been omitted. More particularly, it relates to a method of processing light-sensitive material by use of a water-washing substitute processing solution, which is capable of preventing stains from generating at an unexposed portion when processed in a continuous processing.

In general, light-sensitive materials, having been subjected to image exposure, are processed by processing steps such as color developing, bleaching, fixing, stabilizing, bleach-fixing and water-washing. In these processing steps, it has recently come into serious question increasingly that water source is being drained, cost for water-washing is increasing because of a rise in price of crude oil, and so forth.

For this reason, as a means for omitting the step of water-washing or decreasing extremely the amount of water for the washing, it has been proposed a processing technique of multi-stepwise countercurrent stabilization as disclosed in Japanese Unexamined Patent Publication No. 8453/1982, or a processing technique containing a complex salt of bismuth as disclosed in Japanese Unexamined Patent Publication No. 134636/1983.

However, in order to apply the processing method of the multi-stepwise countercurrent system employing a water-washing substitute stabilizing solution to a small-sized automatic processing machine requiring only a smaller installation area and a lower cost, which has recently been desired by users, it is necessary to reduce the number of tanks, and, as a problem which could not be anticipated when the number of tanks was reduced, the present inventors found that, when a continuous processing is carried out for such a long period of time that the total amount of replenishing solution for a water-washing substitute processing tank solution may become 6 to 7 times or more of the volume of a tank for the water-washing substitute processing, cyan colored color spots are generated on a processing light-sensitive material to show as stains. In particular, the color spots, i.e. the stains, are remarkable at an unexposed portion, and, especially in a color paper, where the unexposed portion comprises a white ground, it was found that even a small number of stains comes to be a serious defect.

It was also found that, although the cyan stains may disappear with lapse of time, they become a very serious problem when viewed from a standpoint as commercial goods.

SUMMARY OF THE INVENTION

Accordingly, it is an object of this invention to provide a technical means for preventing stains from generating at an unexposed portion of a light-sensitive material when a continuous processing is carried out by use of a water-washing substitute stabilizing solution.

The other objects of this invention will become apparent from the description hereinbelow.

As a result of intensive studies, the present inventors have found that the above objects of this invention can be achieved by a method of processing a light-sensitive silver halide color photographic material, comprising color developing a light-sensitive material and then processing it with a processing solution having fixing ability, followed by processing with a water-washing substitute stabilizing solution in a processing tank or tanks comprising 1 to 4 tanks substantially without carrying out any water-washing, wherein said waterwashing substitute stabilizing solution contains at least one of the compounds represented by Formula (I) shown below and at least one of nitrilotriacetic acid and the compounds represented by Formula (II) shown below:

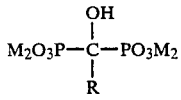

Formula (I)

wherein R represents a hydrogen atom or an alkyl group having 1 to 5 carbons atoms, and M represents a hydrogen atom or an alkali metal atom;

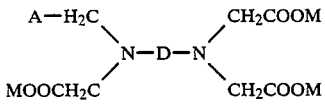

Formula (II)

wherein A represents a carboxyl group or a hydroxymethyl group; D represents an alkylene group having 2 to 4 carbon atoms and having or not having a hydroxyl group, a cyclohexene group, a group of

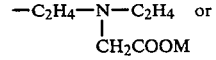

a group of $—C_2H_4OC_2H_4OC_2H_4—$; and M represents a hydrogen atom, an alkali metal atom or an ammonium group.

The present inventors have further found that the object of this invention can be achieved in a higher grade by adding to the water-washing substitute stabilizing solution having the above constitution a quaternary ammonium salt in concentration of $10^{-3}$ or more per one liter of the water-washing substitute stabilizing solution.

DESCRIPTION OF THE PREFERRED EMBODIMENTS

This invention will be described below in detail.

The compound represented by the above Formula (I), the nitrilotriacetic acid and the compound represented by the above Formula (II) are metal chelating agents, each of which indivisually is known to be used in a water-washing substitute stabilizing solution as an improvement agent for yellow stains to be generated when sotoraged in the dark room. However, in the water-washing substitute processing where the step of processing by a water-washing substitute stabilizing solution comprises four or less tank(s) and, in particular, a final tank may become comprised of a dilute fixing solution, it has been quite unknown that the above-mentioned syan stains can be prevented by using the compound represented by Formula (I) and and at least one of the nitrilotriacetic acid and the compound of Formula (II) in combination. This was realized to be a very surprising finding.

The present inventors have also found that deterioration of the water-washing substitute stabilizing solution by oxidation in air, bacteria, or the like can be effectively prevented by using these compounds in combination. This was also a surprising and unexpected finding.

The alkyl group represented by R in the above Formula (I) may be straight-chanined or branched, and the alkali metal atom represented by M may include, for example, lithium, sodium potassium, etc. M in the molecule may be the same or different.

Typical examples of the compounds represented by the above Formula (I) include 1-hydroxyethylidene-1,1-diphosphonic acid, 1-hydroxypropylidene-1,1-diphosphonic acid, 1-hydroxy-1,1-diphosphonomethane, etc., and particularly preferably, 1-hydroxyethylidene-1,1-diphosphonic acid.

The above compounds may be added in an amount ranging from 0.05 g to 50 g, particularly preferably 0.1 t to 10 g, per one liter of the water-washing substitute stabilizing solution.

The M is the above Formula (II) may be the same or different. Typical examples of the compounds represented by Formula (II) include ethylenediaminetetraacetic acid, diethylenetriaminepentaacetic acid, N-hydroxyethyl ethylenediaminetriacetic acid, 1,2-diaminopropanetetraacetic acid, 2-hydroxy-1,3-diaminopropanetetraacetic acid, glycol ether diaminetetraacetic acid, etc. Particularly preferable compounds are ethylenediaminetetraacetic acid, N-hydroxyethyl ethylenediaminetriacetic acid, 2-hydroxy-1,3-diaminopropanetetraacetic acid and 1,2-diaminopropanetetraacetic acid, and also, alkali metal salts and ammonium salts of these.

The above compounds selected from nitrilotriacetic acid and the compounds represented by Formula (II) may be added in an amount ranging from 0.05 g to 50 g, particularly preferably 0.1 g to 10 g, per one liter of the water-washing substitute stabilizing solution.

Further, of the compounds selected from the nitrilotriacetic acid and the compounds represented by Formula (II), the most preferred compound is ethylenediaminetetraacetic acid.

The quaternary ammonium salt mentioned above includes the one having a cation comprising $(R')_4N^{\oplus}$ or pyridinium. The R' in the $(R')_4R^{\oplus}$ may be the same or different and each represent a hydrogen atom, an alkyl group or an aryl group. This alkyl group preferably has 4 or less carbon atom(s) (for example, methyl, ethyl, iso-propyl, etc.), and the aryl group may include phenyl, naphthyl, etc. Examples of $(R')_4N^{\oplus}$ are ammonium, methyl ammonium, ethyl ammonium, etc. The cation of the quaternary ammonium salt is preferably ammonium. The anion thereof includes acid radicals of inorganic acids and organic acids.

Preferable quaternary ammonium salts may include ammonium acetate, ammonium sulfamate, ammonium sulfite, ammonium borate, ammonium hydroxide, ammonium thiosulfate, ammonium sulfate, ammonium chloride, ammonium salts of the compounds of formula (II) and ammoniums salts of nitrilotriacetic acid.

The above compounds may be added in an amount of 1 mole or less, preferably ranging from 0.005 to 0.5 mole per one liter of the water-washing substitute stabilizing solution.

A complex of the compound of Formula (II) of the invention with an iron ion is generally used as a bleaching agent. Since it is added in a bleaching solution or a bleach-fixing solution, it is carried into the water-washing substitute stabilizing solution by a light-sensitive material. This iron complex is a substance which causes stains during storage of images and also promotes oxidation in the water-washing substitute stabilizing solution to cause the deterioration of the solution.

On the other hand, the chelating agents meant by the compounds of Formula (I) or (II) and nitrilotriacetic acid, which are compounds formed by coordination of a hydrogen atom and an alkali metal such as sodium atom, potassium atom and lithium atom of an ammonium salt, are different from the complex of the compound of Formula (II) with an iron ion, and, for this reason, prevents an unexposed portion from staining without causing the above stains during the storage of images.

In order to effectively achieve the object of this invention, the water-washing substitute stabilizing agent according to this invention should have the pH preferably ranging from 3.0 to 11.0, more preferably 6.0 to 11.0, particularly preferably 7.0 to 10.0. As a pH adjuster which may be contained in the water-washing substitute stabilizing solution of the invention, any of generally known alkaline agents and acidic agents may be used.

To the water-washing substitute stabilizing solution used in this invention, there may be added a salt of organic acid (citric acid, acetic acid, succinic acid, oxalic acid, benzoic acid, etc.), a pH adjuster (phosphate, borate, hydrochloric acid, sulfate, etc.) a fungicide (a phenol derivative, a catechol derivative, a sulfate drug, a thiazole derivative, an oxazole derivative, an imidazole derivative, a triazole derivative, a thiabendazole derivative, an organic halogen compound, the other mildew-proofing agents known as slime-controlling agents used in paper or pulpe industries, etc.), a metal chelating agent, a surfactant, an antiseptic agent, a salt of metals such as Bi, Mg, Zn, Ni, Al, Sn, Ti and Zr; etc. These compounds may be used in any optional combination and in such an amount that is necessary for maintaining the pH of the water-washing substitute stabilizing bath of the invention and, at the same time, may not adversely affect the stability and the generation of precipitates during the storage of color photographic images.

The step of processing by the water-washing substitute stabilizing solution according to this invention comprises processing tank(s) having four or less tank(s). Preferably, it is of a countercurrent system (i.e., a system in which a solution is supplied to a posterior bath and allowed to overflow from an anterior bath). The effect of the invention is more remarkable when it comprises three or less tank(s), and the effect of the invention is particularly remarkable when it comprises two or less tank(s).

In this invention, the effect thereof is favorably shown when the amount of replenishment to a processing bath using the water-washing substitute stabilizing solution is 1.5 to 30 times of the amount of the solution carried from a bath previous to the processing bath using the water-washing substitute stabilizing solution into the processing bath using the water-washing substitute stabilizing solution, based on calculation per unit area of a light-sensitive material to be processed. The effect is more remarkable when the above former amount is 2 to 20 times of the latter amount. The amount of the solution to be carried-in may vary depending on the kind of light-sensitive material, the driving speed of an automatic processing machine, the driving system, the system for squeezing the surface of a light-sensitive material, etc., but in the case of a color paper it usually may range from 25 ml/m$^2$ to 100 ml/m$^2$.

Accordingly, relative to the amount of the solution to be carried-in, the replenishing amount which gives remarkable effect of the invention is in the range of 50 ml/m$^2$ to 2,000 ml/m$^2$, and particularly remarkably effective replenishing amount is in the range of 75 ml/m$^2$ to 900 ml/m$^2$.

In the case of color films (roll films), the amount of the solution to be carried-in is usually in the range of from 50 ml/m$^2$ to 150 ml/m$^2$. Accordingly, relative to this amount of the solution to be carried-in, the replenishing amount giving more remarkable effect of the invention is in the range of 100 ml/m$^2$ to 3.0 lit/m$^2$, and particularly remarkably effective replenishing amount is in the range of 150 ml/m$^2$ to 950 ml/m$^2$.

Further, this invention is particularly effective when the fixing component which is contained in the final tank of the water-washing substitute stabilizing solution, carried in it by light-sensitive materials, is a thiosulfate, and the concentration of the thiosulfate contained in the final tank ranges from 0.05 g/lit to 30 g/lit, particularly from 0.1 g/lit to 20 g/lit.

Still further, this invention is particularly effective when the specific gravity in the final tank of the water-washing substitute stabilizing solution ranges from 1.003 to 1.050.

The processing temperature for the processing (stabilizing processing) by the water-washing substitute stabilizing solution may range from 15° C. to 60° C., preferably from 20° C. to 45° C. Also, the processing time is preferably to be as short as possible from the viewpoint of speedy processing, and it may range usually from 20 seconds to 10 minutes, most preferably from 1 minute to 3 minutes, and it is preferred that, when the processing is carried out by using a plural number of tanks, the processing time is shorter in anterior tanks and longer in posterior tanks. In particular, it is desirable that the processing is carried out successively in the processing time of 20% to 50% longer than every previous tank. No water-washing is required at all after the stablizing processing carried out in accordance with this invention, but is is possible to optionally carry out rinsing or surface washing for a very short period of time by using a rinse containing formaline, an activator, etc.

In this invention, after the color developing, the light-sensitive material is processed with a processing solution having fixing ability. This refers to the step at which, after processing by use of an ordinary color developing solution, a fixing bath or a bleach-fixing bath is used for the purpose of fixing the light-sensitive material. Namely, this invention has solved the problem involved in a water-washing substitute stabilizing solution used after processing of a light-sensitive material in a fixing bath or a bleach-fixing bath after the color developing. Details for the color developing solution, the fixing solution and the bleach-fixing solution will be set out hereinlater.

The method according to this invention shows particularly remarkable effect when applied to a light-sensitive material containing a light-sensitive silver halide sensitized with a sensitizing dye represented by Formula (III) of Formula (IV) shown below:

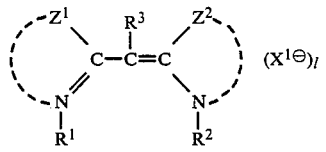

Formula (III)

wherein $Z^1$ and $Z^2$ each represent an atomic group necessary for formation of a benzothiazole nucleus, a naphthoxazole nucleus, a benzothiazole lucleus, a naphthothiazole nucleus, a benzocelenazole nucleus, a naphthocelenazole nucleus, a benzoimidazole nucleus, a naphthoimidazole nucleus, a pyridine nucleus or a quinoline nucleus. $R^1$ and $R^2$ each represents a group selected from an alkyl group, an alkenyl group and aryl group, and preferably represent an alkyl group. $R^3$ represents a hydrogen atom, a methyl group or an ethyl group. $X^{1-}$ represents an anion, and l is an integer of 0 or 1.

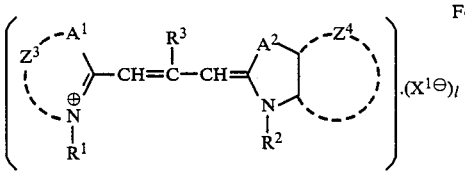

Formula (IV)

wherein $Z^3$ and $Z^4$ each represent an atomic group necessary for formation of a benzene ring or a naphthalene ring condensed at an oxazole ring or a thiazole ring. Heterocyclic rings formed may be substituted with various kinds of substituents, which may include preferably a halogen atom, an aryl group, an alkenyl group, an alkyl group and an alkoxyl group. Of these, more preferable substituents are a halogen atom, a phenyl group and a methoxyl group, and the most preferable substituent is a phenyl group.

Preferably, $Z^3$ and $Z^4$ are each a benzene ring or a thiazole ring condensed at an oxazole ring, and at least one benzene ring of these benzene rings is substituted on the 5-position with a phenyl group or, alternatively, one of the benzene rings is substituted with a phenyl group and the other benzene ring is substituted on the 5-position with a halogen atom. $R^1$ and $R^2$ have the same meaning as those in Formula (III).

Preferably, $R^1$ and $R^2$ are each an alkyl group substituted with a carboxyl group or a sulfo group. Such an alkyl group is most preferably a sulfoalkyl group having 1 to 4 carbon atoms, and still most preferably a sulfoethyl group. $R^3$ represents a hydrogen atom or an alkyl group having 1 to 3 carbon atoms, and preferably a hydrogen atom or an ethyl group, $X^{1\ominus}$ represents an anion and l represents an integer of 0 or 1. $A^1$ and $A^2$ each represent an oxygen atom or a sulfur atom.

The sensitizing dye used in this invention and represented by Formula (III) of Formula (IV) may be used in combination with the other sensitizing dyes as a so-called strong color sensitizable combination. In such a case, each of the sensitizing dyes may be dissolved in a same or different kind of solvent, and resulting solutions may be mixed before adding them to an emulsion or may be separately added to the emulsion. When they are separately added, the sequence of addition and the time interval may be determined optionally in accordance with an object.
Exemplary compounds for the sensitizing dye represented by Formula (III) or Formula (IV) are shown in but by no means limited by the following:
I-1
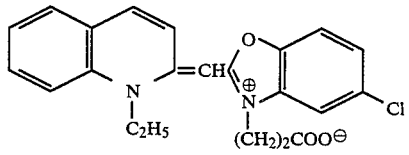
I-2
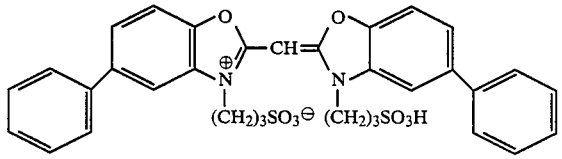
I-3
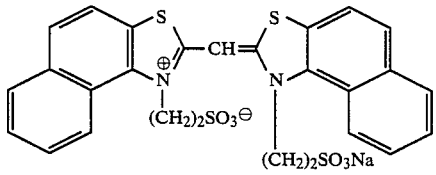
I-4
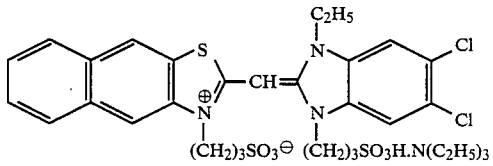
I-5
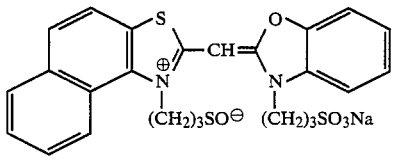
I-6
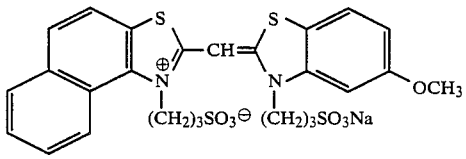
I-7
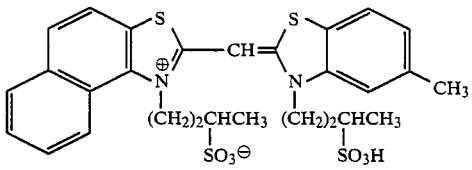
I-8
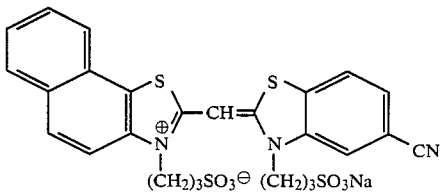

-continued
I-9
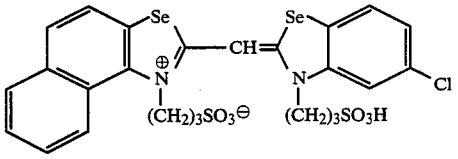
I-10
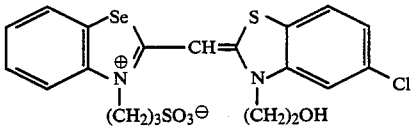
I-11
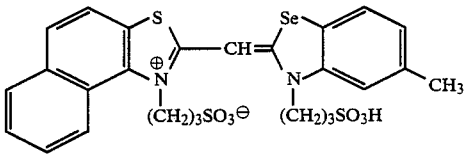
I-12
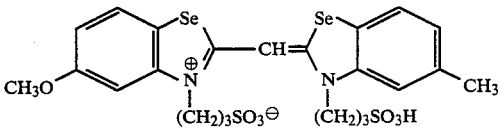
I-13
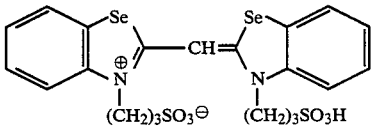
I-14
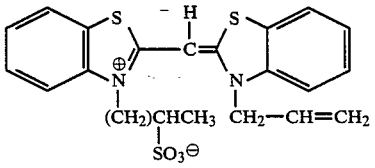
I-15
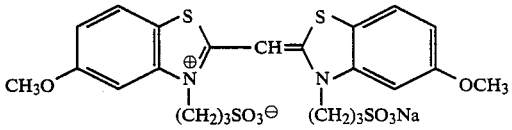
I-16
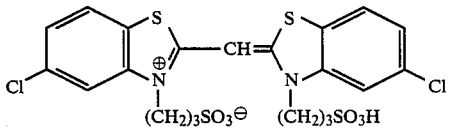
I-17
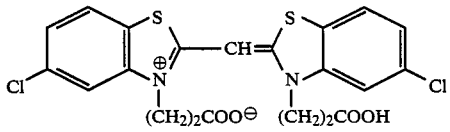
I-18
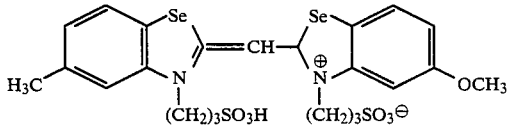

-continued
I-19
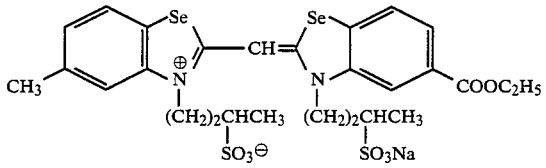
I-20
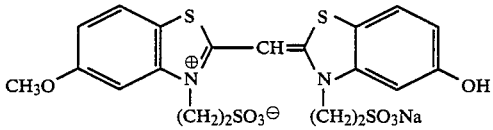
I-21
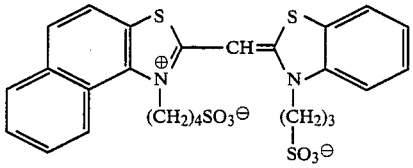
I-22
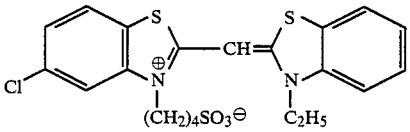
I-23
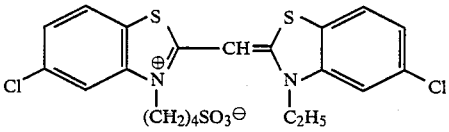
(II-1)
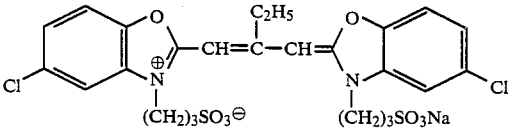
(II-2)
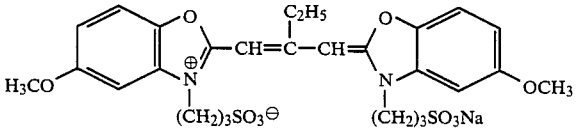
(II-3)
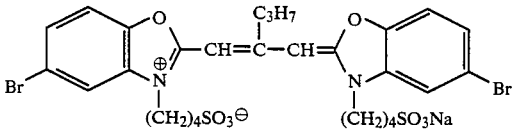
(II-4)
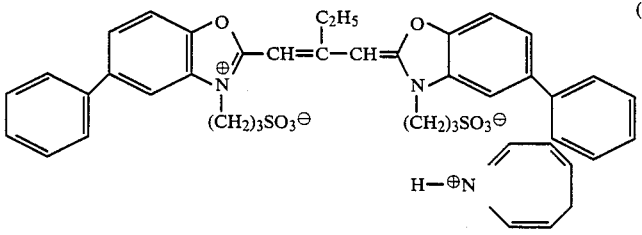

-continued
(II-5)
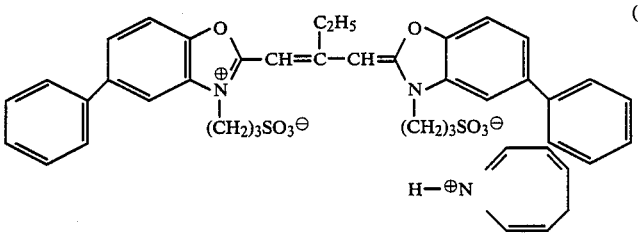
(II-6)
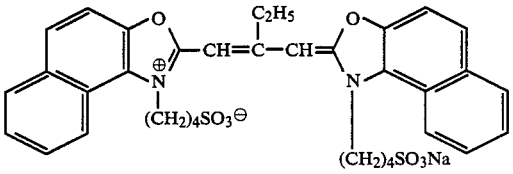
(II-7)
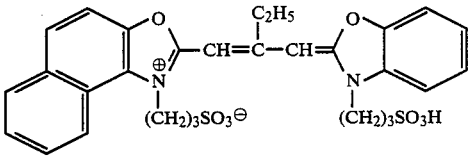
(II-8)
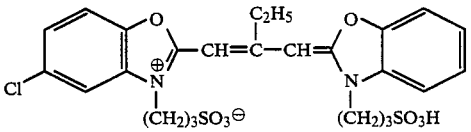
(II-9)
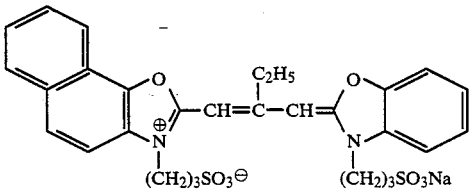
(II-10)
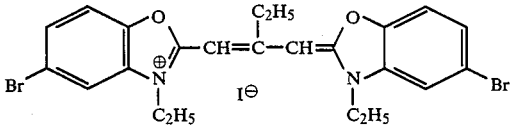
(II-11)
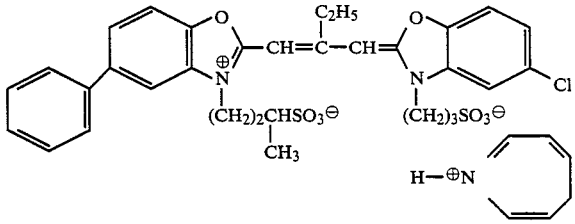
(II-12)
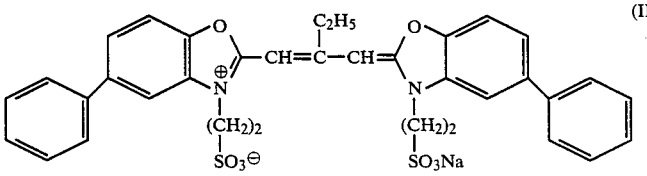

-continued (II-13)

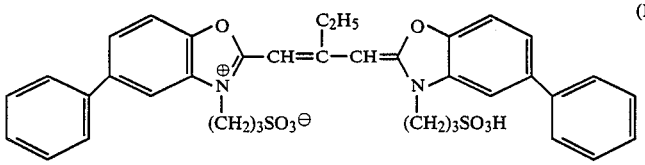

(II-14)

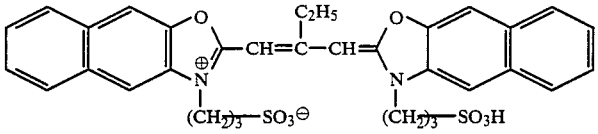

(II-15)

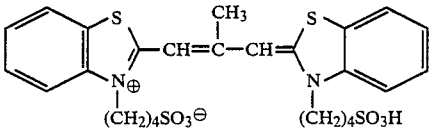

(II-16)

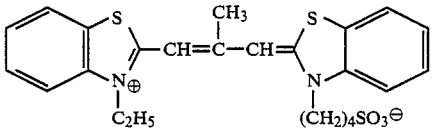

(II-17)

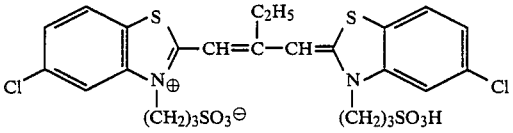

(II-18)

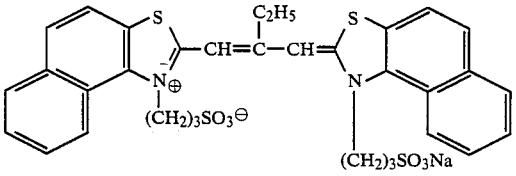

(II-19)

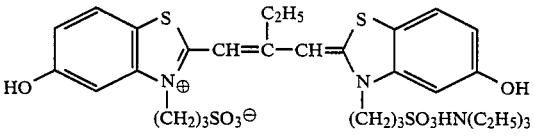

The effect of the invention is particularly remarkable for a light-sensitive material in which the sensitizing dye represented by the above Formula (III) or Formula (IV) is added to an emulsion in an amount ranging from $2\times10^{-6}$ to $1\times10^{-3}$ mole per mole of silver halide, and the effect is more remarkable when added in an amount ranging from $10^{-6}$ to $5\times10^{-4}$ mole.

In the light-sensitive material to which the method of this invention is applied, silver halide emulsion layers and non-sensitive layers (non-emulsion layers) are provided on a support by coating, and the silver halide emulsion may be those which is comrised of any silver halides such as silver chloride, silver bromide, silver iodide, silver chlorobromide, silver chloroiodide, silver iodobromide and silver chloroiodobromide. In these emulsion layers and non-sensitive layers, any couplers and additives known in the photographic field may be contained. For example, there may be suitably contained a yellow dye forming coupler, a mazenta dye forming coupler, a cyane dye forming coupler, a stabilizing agent, a sensitizing dye, a gold compound, a high boiling organic solvent, an antifoggant, a dye image discoloration preventive agent, a color stain preventive agent, a brightening agent, an antistatic agent, a hardening agent, a surfactant, a plasticizer, a wetting agent, an ultraviolet absorbent, etc.

The light-sensitive material to which the method of this invention is applied is prepared by providing the respective constituting layers such as emulsion layers and non-sensitive layers, in which the above-mentioned various kinds of photographic additives are optionally contained, by coating on a support having been applied with corona discharge treatment, flame treatment for ultraviolet irradiation treatment, or on a support with interposition of a subbing layer and an intermediate layer. The support advantageously usable includes, for example, a baryta paper, a polyethylene coated paper, a polypropyrene synthetic paper, a transparent support provided with a reflective layer or using a reflective member in combination, for example, a glass plate, cellulose acetate, cellulose nitrate, a polyester film of polyethylene terephthalate or the like, a polyamide film, a polycarbonate film, a polystyrene film, etc.

The greater part of the above silver halide emulsion layers and the non-sensitive layers is comprised of a hydrophilic colloid layer containing a hydrophilic binder. As the hydrophilic binder, there may be used preferably gelatin or gelatin derivatives such as acylated gelatine, guanidylated gelatin, phenyl carbamyl gelatin, phthalic gelatin, cyanoethanol gelatin, esterified gelatin, etc.

A hardening agent for hardening this hydrophilic colloid layer may include, for example, chromium salts (chrome alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenated acids (mucochloric acid, mucophenoxychloric acid, etc.), etc. which may be used singularly or in combination.

In the method of this invention, the effect of the invention is particularly remarkable when the thickness of total dried layers of the emulsion layers and the non-sensitive layers on one side of a support for a light-sensitive material is in the range of 5 to 20 μm. The invention is more effective when the above layer thickness is in the range of 5 to 15 μm.

Also, this invention is particularly effective when the light-sensitive material is of the so-called oil protect type in which couplers having been contained in a high boiling organic solvent are contained in a dispersed state. The effect of the invention becomes greater when any of the following is used as the above high boiling organic solvent; namely, organic amides, carbamates, esters, ketones, urea derivatives, etc.; particularly, phthalates such as dimethyl phthalate, diethyl phthalate, dipropyl phthalate, dibutyl phthalate, di-n-octyl phthalate, diisooctyl phthalate, diamyl phthalate, dinonyl phthalate and diisodecyl phthalate; phosphates such as tricresyl phosphate, triphenyl phosphate, tri-(2-ethylhexyl)phosphate and tri-n-nonyl phosphate; sebacates such as dioctyl sebacate, de-2-(ethylhexyl)sebacate and diisodecyl sebacate; esters of glycerin such as glycerol tripropionate and glycerol tributylate; and also, adipates, glutarates, succinates, maleates, fumarates, citrates and phenol derivatives such as di-tert-amyl phenol and n-octyl phenol.

For the sake of image preservability, it is most preferred that a cyan coupler represented by Formula (V) shown below is used in the light-sensitive material to which the method of this invention is applied.

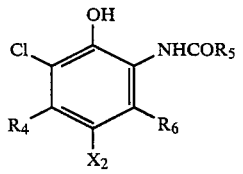

Formula (V)

wherein any one of $R^4$ and $R^6$ represents a hydrogen atom and the other of them represents a straight-chain or branched alkyl group having 2 to 12 carbon atoms; $X^2$ represents a hydrogen atom or a group eliminable by a coupling reaction; and $R^5$ represents a ballast group.

In the following, exemplary compounds of the cyan coupler represented by the above Formula (V) are shown below. Examples of the compounds other than the exemplary compounds shown below may include the exemplary compounds disclosed in Japanese Patent Application No. 95613/1984.

(Exemplary Compound)

| Coupler No. | $R^4$ | $X^2$ | $R^5$ | $R^6$ |
|---|---|---|---|---|
| (1) | $-C_2H_5$ | $-Cl$ | 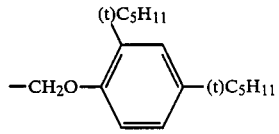 | $-H$ |
| (2) | $-C_2H_5$ | 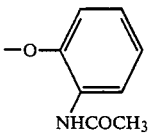 | 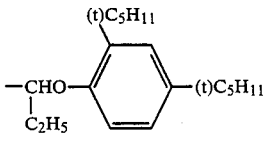 | $-H$ |
| (3) | 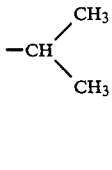 | $-Cl$ | 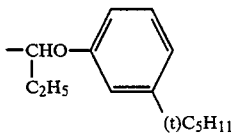 | $-H$ |
| (4) | $-C_2H_5$ | $-Cl$ | 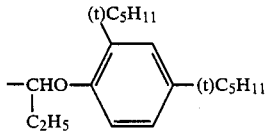 | $-H$ |

-continued (Exemplary Compound)

| Coupler No. | $R^4$ | $X^2$ | $R^5$ | $R^6$ |
|---|---|---|---|---|
| (5) | $-C_2H_5$ | $-Cl$ | 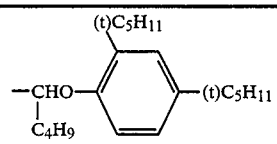 | $-H$ |
| (6) | $-C_4H_9$ | $-F$ | 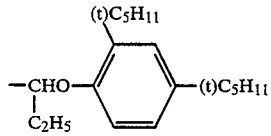 | $-H$ |

In the color development performed in this invention, there is used an aromatic primary amine color developing agent, which may include known agents widely used in the various color photographic processes. These developing agents include aminophenol type derivatives and phenylenediamine type derivatives. These compounds are generally used in the form of salts, for example, in the form of hydrochlorides or sulfates, rather than those in a free state for the sake of stableness. Also, these compounds are used in concentration of about 0.1 g to about 30 g, preferably about 1 g to about 1.5 g, per one liter of the color developing solution.

The aminophenol type developing agents may include, for example o-aminophenol, p-aminophenol, 5-amino-2-oxytoluene, 2-amino-3-oxytoluene, 2-oxy-3-amino-1,4-dimethylbenzene, etc.

Particularly useful aromatic primary amine type color developing agents are N,N'-dialkyl-p-phenylenediamine type compounds, in which an alkyl group and a phenyl group may be substituted with an optional substituent. Of these, particularly useful compounds may include, for example, N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-$\beta$-methanesulfonamide, ethyl-3-methyl-4-aminoaniline sulfate, N-ethyl-N-$\beta$-hydroxyethylaminoaniline, 4-amino-3-methyl-N,N-'-diethylaniline, 4-amino-N-(2-methoxyethyl)-N-ethyl-3-methylaniline-p-toluenesulfonate, etc.

In addition to the above aromatic primary amine type color developing agents, the color developing solution may further optionally contain various components usually added to a color developing solution, for example, an alkali agent such as sodium hydroxide, sodium carbonate and potassium carbonate, an alkali metal thiocyanate, an alakli metal halogenated compound, benzyl alcohol, a softener, a thickening agent, etc. The color developing solution using the aromatic primary amine color developing agent as a color developing agent may have the ph value generally of 7 or more, and most generally about 10 to about 13.

In the processing solution having fixing ability in this invention, there may be used as a fixing agent, for example, thiosulfates (disclosed in Japanese Unexamined Patent Publication No. 185435/1982), thiocyanates (disclosed in British Patent No. 565,135 and Japanese Unexamined Patent Publication No. 137143/1979), halogen compounds (disclosed in Japanese Unexamined Patent Publication No. 130639/1977), thioethers (disclosed in Belgium Patent No. 626,970), thioureas (disclosed in British Patent No. 1,189,416), etc. Of these fixing agents, it is thiosulfates that can achieve the effect of this invention particularly effectively. Also, the effect of this invention is particularly remarkable when the processing solution having fixing ability is a bleach-fixing solution, and there may be used as a bleaching agent the organic ferric complex salts (disclosed in Japanese Patent Publication No. 38895/1979, Japanese Unexamined International Patent Publication No. 500704/1980, Japanese Unexamined Patent Publications No. 52748/1981 and No. 149358/1984).

Further, when the processing solution having fixing ability, used in this invention, is a processing solution used for the purpose of fixing processing, any bleaching agent may be used as the bleaching agent for carrying out the bleaching processing at a step previous to the fixing processing, and there may be used red prussiates, ferric chlorides (disclosed in British Patent No. 736,881 and Japanese Patent Publications No. 44424/1981), persulfuric acids (disclosed in German Patent No. 21 41 199), hydrogen peroxides (disclosed in Japanese Patent Publication No. 11617/1983 and No. 11618/1983), organic acid ferric complex salts (disclosed in Japanese Unexamined Patent Publications No. 70533/1982, No. 43454/1983 and Japanese Unexamined Patent Publication No. 166951/1984, etc.

Silver recovery may be made in a conventional manner from the processing solutions such as a fixing solution and a bleach-fixing solution, not to seak of the water-washing substitute stabilizing solution used in the processing method of this invention, each of which contain soluble silver complex slats. For example, an electrolysis method (disclosed in French Patent No. 2,299,667), a precipitation method (disclosed in Japanese Unexamined Patent Publication No. 73037/1977 and German Patent No. 23 31 220), an ion exchange method (disclosed in Japanese Unexamined Patent Publication No. 17114/1976 and German Patent No. 25 48 237), a metal substitution method (disclosed in British Patent No. 1,353,805), etc. may be effectively utilizable.

The processing method of this invention may be advantageously applied to the processing of a color negative paper, a color positive paper and a color reversal paper. Also, the processing steps by which this invention is particularly effectively realized may include, for example, the following (1) and (2):

(1): color developing - bleach-fixing - water-washing substitute stabilizing processing (2): color developing - bleaching - fixing -water-washing substitute stabilizing processing This invention will be described in greater detail by the following Examples, by which, however, embodiments of this invention are not limited.

EXAMPLE 1

An experiment was carried out by use of a color paper, processing solutions and processing steps mentioned below:

[Color paper]

Each of the layers mentioned below was provided by coating on a support made of a polyethylene coated paper, in the order from the support side, to prepare a light-sensitive material.

As the polyethylene coated paper, used was one obtained by forming on the surface of a high quality paper of 170 g/m$^2$ in weight by an extrusion coating method a coated layer of 0.035 mm in thickness comprising a mixture of 200 parts by weight of polyethylene having a mean molecular weight of 100,000 and a density of 0.95 and 20 parts by weight of polyethylene having a mean molecular weight of 2,000 and density of 0.80, to which 6.8% by weight of titanium oxide of anatase type, and on the reverse side thereof, provided with a coated layer of 0.040 mm in thickness comprising polyethylene only. Pretreatment by the corona discharge was applied on the polyethylene coated face on the surface of this support, and thereafter, each of the layers was provided in order by coating.

First layer:

A blue-sensitive silver halide emulsion layer comprising a silver chlorobromide emulsion containing 80 mole % of silver bromide; said emulsion containing 350 g of gelatin per mole of silver halide, being sensitized by use of 7.5 x 10-4 mole of a sensitizing dye having the following chemical structure:

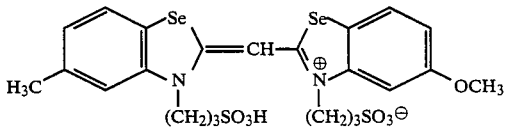

per mole of silver halide (wherein isopropyl alcohol was used as a solvent), containing 200 mg/m$^2$ of 2,5-di-t-butylhydroquinone dispersed by dissolving it in dibutylphthalate and, as a yellow coupler, 2 x 10-1 mole of α-[4-(1-benzyl-2-phenyl-3,5-dioxo-1,2,4-triazolidyl)]α-pivalyl-2-chloro-5-[γ-(2,4-di-t-amylphenoxy)butylamide]acetoanilide per mole of silver halide, and being coated so as to have the silver amount of 330 mg/m$^2$.

Second layer:

A gelatin layer containing 300 mg/m$^2$ of di-t-octylhydroquinone and, as a ultraviolet absorbent, 200 mg/m$^2$ of a mixture of 2-(2'-hydroxy-3'-,5'-di-t-butylphenyl)-benzotriazole-2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3',5'-di-t-butylphenyl)-5-chlorobenzotriazole, which is coated to have the gelatin amount of 2000 mg/m$^2$.

Third layer:

A green-sensitive silver halide emulsion layer comprising a silver chlorobromide emulsion containing 85 mole % of silver bromide; said emulsion containing 450 g of gelatin per mole of silver halide, being sensitized by use of $7.5\times10^{-4}$ mole of a sensitizing dye having the following chemical structure:

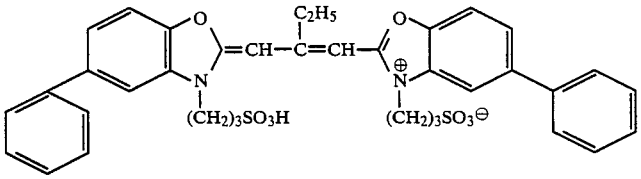

per mole of silver halide, containing 150 mg/m$^2$ of 2,5-di-t-butylhydroquinone dispersed by dissolving it in a solvent obtained by mixing dibutylphthalate and tricresyl phosphate in proportion of 2:1 and, as a mazenta coupler, $1.5\times10^{-1}$ mole of 1-(2,4,6-trichlorophenyl)-3-(2-chloro-5-octadecenylsuccinimideanilino)-5-pyrazolone per mole of silver halide, and being coated to have the silver amount of 300 mg/m$^2$. Further, 0.3 mole of 2,2,4-trimethyl-6-lauryloxy-7-t-octyl chromene per mole of coupler was contained as an antioxidant. Fourth layer:

A gelatin layer containing 30 mg/m$^2$ of di-t-octlyhydroquinone dispersed by dissolving it in dioctylphthalate and, as a ultraviolet absorbent, 500 mg/m$^2$ of a mixture (2:1.5:1.5:2) of 2-2'-hydroxy-3',5'-di-t-butylphenyl)benzotriazole, 2-(2'-hydroxy-5'-t-butylphenyl)-benzotriazole, 2-(2'-hydroxy-3-t-butyl-5'-methylphenyl)-5-chlorobenzotriazole and 2-(2'-hydroxy-3',5'-t-butylphenyl)-5-chlorobenzotriazole, which was coated to have the gelatin amount of 2000 mg/m$^2$.

Fifth layer:

A red-sensitive silver halide emulsion layer comprising a silver chlorobromide emulsion containing 85 mole % of silver bromide; said emulsion containing 500 g of gelatin per mole of silver halide, being sensitized by use of $2.5\times10^{-5}$ mole of a sensitizing dye having the following chemical structure:

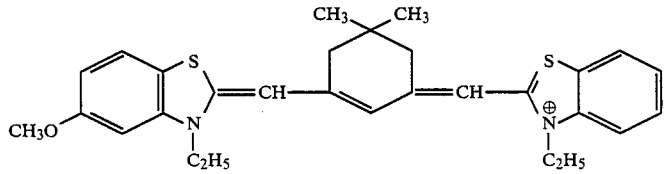

per mole of silver halide, containing 150 mg/m$^2$ of 2,5-di-t-butylhydroquinone dispersed by dissolving it in dibutylphthalate and, as a cyan coupler, $3.5\times10^{-1}$ mole of Exemprary Compound (4) per mole of silver halide, and being coated to have the silver amount of 300 mg/m$^2$.

Sixth layer:

A gelatin layer, in which gelatin was coated to have the amount of 1000 mg/m$^2$.

The silver halide emulsions used in the respective light-sensitive emulsion layers (first, third and fifth layers) were prepared according to the method disclosed in Japanese Patent Publication No. 7772/1971, each of which was chemically sensitized by use of sodium thiosulfate pentahydrate, and in each of which 4-hydroxy-6-methyl-1,3,3a,7-tetrazaindene was contained as a stabilizing agent, bis(vinylsulfonylmethyl)-ether as a hardening agent and saponin as a coating additive.

The layer thickness of the above after coating and drying was measured to find that it was 13 μm.

After exposure of the color paper prepared according to the above method, continuous processing was carried out by use of the following processing steps and processing solutions.

| Standard processing steps: | | |
|---|---|---|
| [1] Color developing | 38° C. | 3 minutes 30 seconds |
| [2] Bleach-fixing | 33° C. | 1 minute 30 seconds |
| [3] Processing by water-washing substitute stabilizing solution | 25° C. to 35° C. | 2 minutes |
| [4] Drying | 75° C. to 100° C. | about 2 minutes |

Composition of processing solutions:

| (Color development tank solution) | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| 3-Methyl-4-amino-N—ethyl-N—(ethyl β-methanesulfonamide)-aniline sulfate | 5.5 g |
| Brightening agent (4,4'-diaminostylbene type) | 1.0 g |
| Hydroxylamine sulfate | 3.0 g |
| Hydroxyethyliminodiacetic acid | 5.0 g |
| Disodium 1,2-dihydroxybenzene-3,5-disulfonate | 0.2 g |
| Made up to one liter by adding water and adjusted to pH 10.20 by using KOH and $H_2SO_4$. | |

| (Color development replenishing solution) | |
|---|---|
| Benzyl alcohol | 20.0 ml |
| Ethylene glycol | 15.0 ml |
| Potassium sulfite | 3.0 g |
| Potassium carbonate | 30.0 g |
| Hydroxyamine sulfate | 4.0 g |
| 3-Methyl-4-amino-N—ethyl-N—(ethyl β-methanesulfonamide)-aniline sulfate | 7.5 g |
| Brightening agent (4,4'-diaminostylbene type) | 2.5 g |
| Hydroxyethyliminodiacetic acid | 5.0 g |
| Disodium 1,2-hydroxybenzene-3,5-disulfonate | 0.3 g |
| Made up to one liter by adding water and adjusted to pH of 10.70 by using KOH. | |

| (Bleach-fixing tank solution) | |
|---|---|
| Ferric ammonium ethylenediaminetetraacetic acid dihydrate | 60 g |
| Ethylenediaminetetraacetic acid | 3 g |
| Ammonium thiosulfate (70% solution) | 100 ml |
| Ammonium sulfite (40% solution) | 27.5 ml |
| Made up to one liter in total amount by adding water along with adjustment of pH to 7.1 by use of potassium carbonate or glacial acetic acid. | |

| (Bleach-fixing replenishing solution A) | |
|---|---|
| Ferric ammonium ethylenediaminetetraacetic acid dihydrate | 260 g |
| Potassium carbonate | 420 g |
| Made up to one liter in total iron amount by adding water. | |
| This solution had a pH of 6.7 ± 0.1. | |

-continued

| (Bleach-fixing replenishing solution B) | |
|---|---|
| Ammonium thiosulfate (70% solution) | 500 ml |
| Ammonium sulfite (40% solution) | 250 ml |
| Ethylenediaminetetraacetic acid | 17 g |
| Glacial acetic acid | 85 ml |
| Made up to one liter by adding water and adjusted to pH 7.0 by using $H_2SO_4$ and KOH. | |

| (Water-washing substitute stabilizing tank solution and its replenishing solution) | |
|---|---|
| Fluorinated sulfamide hydrochloride | 0.10 g |
| Sulfanilamide hydrochloride | 0.10 g |
| Polyvinylpyrrolidone | 1.0 g |
| Made up to one liter by adding water and adjusted to pH 7.0 by using $H_2SO_4$ and KOH. | |

An automatic processing machine was full-supplied with the above color development tank solution, the bleach-fixing tank solution and the water-washing substitute stabilizing tank solution, to carry out processing of the color paper, during which a running test was carried out while replenishing the above color development replenishing solution, the bleach-fixing replenishing solutions A and B and the water-washing substitutive stabilizing solution, respectively, through quantity measuring cups at every interval of 3 minutes. Replenishing amounts were such that the amount for replenishing the color development tank with the color development replenishing solution was 190 ml, the amount for replenishing the bleach-fixing tank with the bleach-fixing replenishing solutions A and B was 50 ml each and the amount for replenishing the stabilizing processing tank with the water-washing substitute stabilizing solution was 200 ml, respectively, per 1 m$^2$ of the color paper.

Water-washing substitute processing tanks in the automatic processing machine had the construction such that the processing tanks comrise a first to third tanks arranged in the direction of the flow of the light-sensitive material to take the countercurrent system in which an overflow from a last tank is flowed in a tank previous to the last tank and an overflow from this tank is further flowed in a tank previous thereto, and a blade squeesee was provided at the outlet of each of the tanks. The amount of the bleach-fixing solution carried-in by the light-sensitive material was 25 ml/m$^2$.

Continuous processing was carried out until the total replenishing amount of the water-washing substitute stabilizing solution reached 5 times of the tank volume for the water-washing substitute stabilizing solution.

After the continuous processing, 10 samples were collected with one liter portions from each of the water-washing substitute stabilizing solutions in the first to the third tanks, and the additive(s) as shown in Table 1 were added thereto, while the pH of the mixture was adjusted to 7.5 by use of $H_2SO_4$ and KOH. With use of these processing solutions obtained after the continuous processing, the light-sensitive material prepared as above was processed according to the processing steps mentioned above. Also, as a comparative sample, Sample No. 11 was prepared which was processed by washing with running water in place of the processing with the water-washing substitute stabilizing solution. For each of the resultant samples thus processed, spectral reflection density at 640 nm on its white ground of unexposed portion was measured by use of a 330 type autographic spectrophotometer (produced by Hitachi, Ltd.).

Also, the third tank of the water-washing substitute stabilizing processing tanks corresponding to each of Samples No. 1 to 10 and 12 to 16 was allowed to stand at room temperature to observe its appearance with lapse of time. Results to these are shown in Table 2.

TABLE 1

| Sample No. | Compounds added | |
|---|---|---|
| 1 | None | |
| 2 | 1-Hydroxyethylidene-1,1-diphosphonic acid | 2 g/lit. |
| 3 | Ethylenediaminetetraacetic acid | 2 g/lit. |
| 4 | 1-Hydroxyethylidene-1,1-diphosphonic acid | 1 g/lit. |
| | Hydroxyethyliminodiacetic acid | 1 g/lit. |
| 5 | 1-Hydroxyethylidene-1,1-diphosphonic acid | 1 g/lit. |
| | Dihydroxyethyl glycine | 1 g/lit. |
| 6 | 1-Hydroxyethylidene-1,1-diphosphonic acid | 1 g/lit. |
| | Diethylenetriaminepentaacetic acid | 1 g/lit. |
| 7 | 1-Hydroxyethylidene-1,1-diphosphonic acid | 1 g/lit. |
| | Nitrilotriacetic acid | 1 g/lit. |
| 8 | 1-Hydroxyethylidene-1,1-diphosphonic acid | 1 g/lit. |
| | N—hydroxyethylethylenediamine-triacetic acid | 1 g/lit. |
| 9 | Hydroxyethylidene-1,1-diphosphonic acid | 1 g/lit. |
| | Ethylenediaminetetraacetic acid | 1 g/lit. |
| 10 | 1-Hydroxyethylidene-1,1-diphosphonic acid | 1 g/lit. |
| | Ethylenediaminetetraacetic acid | 1 g/lit. |
| | Ammonia water (25%) | 2 g/lit. |
| 12 | 1-Hydroxypropylidene-1,1-diphosphonic acid | 1 g/lit |
| | Ethylenediaminetetraacetic acid | 1 g/lit. |
| | Ammonia water (25%) | 2 g/lit. |
| 13 | 1-Hydroxypropylidene-1,1-diphosphonic acid | 1 g/lit. |
| | Nitrilotriacetic acid | 1 g/lit. |
| | Ammonia water (25%) | 2 g/lit. |
| 14 | 1-Hydroxy-1,1-diphosphonomethane | 1 g/lit. |
| | Ethylenediaminetetraacetic acid | 1 g/lit. |
| | Ammonia water (25%) | 2 g/lit. |
| 15 | 1-Hydroxyethylidene-1,1-diphosphonic acid | 1 g/lit. |
| | Nitrilotriacetic acid | 1 g/lit. |
| | Ethylenediaminetetraacetic acid | 0.5 g/lit. |
| | Ammonia water (25%) | 2 g/lit. |
| 16 | 1-Hydroxy-1,1-diphosphonomethane | 1 g/lit. |
| | Diehylenetriaminepentaacetic acid | 1 g/lit. |
| | Ammonia water (25%) | 2 g/lit. |

TABLE 2

| Sample No. | Spectral reflection density (640 nm) | Days elapsed for the 3rd tank (*1) 5 | 10 | 15 | 20 | 25 |
|---|---|---|---|---|---|---|
| Comparative | | | | | | |
| 1 | 0.130 | − | ++ | ++ | ++ | ++ |
| 2 | 0.129 | + | ++ | ++ | ++ | ++ |
| 3 | 0.129 | − | − | ++ | ++ | ++ |
| 4 | 0.129 | − | ++ | ++ | ++ | ++ |
| 5 | 0.130 | − | − | ++ | ++ | ++ |
| Present invention | | | | | | |
| 6 | 0.117 | − | − | − | + | + |
| 7 | 0.117 | − | − | − | + | + |
| 8 | 0.113 | − | − | − | − | − |
| 9 | 0.111 | − | − | − | − | − |
| 10 | 0.108 | − | − | − | − | − |
| Comparative (Water-washing) | | | | | | |
| 11 | 0.107 | | | | | |
| Present invention | | | | | | |
| 12 | 0.110 | − | − | − | − | − |
| 13 | 0.115 | − | − | − | − | + |
| 14 | 0.111 | − | − | − | − | + |
| 15 | 0.112 | − | − | − | + | + |

TABLE 2-continued

| Sample No. | Spectral reflection density (640 nm) | Days elapsed for the 3rd tank (*1) 5 | 10 | 15 | 20 | 25 |
|---|---|---|---|---|---|---|
| 16 | 0.118 | − | − | − | + | + |

(*1)− Precipitates and suspended matters were not observed at all.
+ Precipitates and suspended matters were slightly observed.
++ Precipitates and suspended matters were observed to a great extent.

It is seen from Table 2 that both the cyan stain at unexposed portion and the solution storageability are in a very desirable state in respect of Samples No. 6 to No. 10 and 12 to 16 wherein the chelating agent represented by Formula (I) and at least one of the nitrilotriacetic acid and the chelating agent represented by Formula (II) are used in combination in accordance with this invention, as compared with the cases of sole use of a chelating agent and the combined use of chelating agents in a state outside this invention.

EXAMPLE 2

Fourteen (14) samples were collected with one liter portions from the water-washing substitute stabilizing solution obtained after the continuous processing carried out in Example 1, to each of 7 samples of which the compounds of this invention were added in such a combination as shown in Table 3, each of which were adjusted to have the pH as shown in Table 3. To each of the remaining 7 samples, one compound only of the compounds used in combination in this invention was added, each of which were subjected to the similar pH adjustment. In adjusting the pH, a diluted solution of $H_2SO_4$ or KOH was used. With use of each of these pH-adjusted water-washing substitute stabilizing solution, processing was carried out and the measurement of spectral reflection density (640 nm) were carried out in the same manner as in Example 1.

Results are shown in Table 3.

TABLE 3

| Compounds | pH value 2.5 | 3.5 | 6.1 | 7.1 | 9.8 | 10.5 | 11.5 |
|---|---|---|---|---|---|---|---|
| (Present invention) | | | | | | | |
| 1-Hydroxyethylidene-1,1-diphosphonic acid 1 g/lit. Ethylenediaminetetraacetic acid 1 g/lit. | 0.150 | 0.122 | 0.114 | 0.111 | 0.129 | 0.117 | 0.134 |
| (Comparative example) | | | | | | | |
| 1-Hydroxyethylidene-1,1-diphosphonic acid 2 g/lit. | 0.162 | 0.145 | 0.133 | 0.130 | 0.129 | 0.132 | 0.134 |

As will be seen from Table 3, in this invention the water-washing substitute stabilizing solution has preferably the ph of 3.0 to 11.0, more preferably the pH of 6.0 to 11.0, and most preferably the pH of 7.0 to 10.0

EXAMPLE 3

Using the light-sensitive material, the processing step and the processing solutions used in Example 1 (provided that, as the water-washing substitute stabilizing solutions, the solution for comparison and the solution of the invention shown below were used), continuous processing was carried out for each of water-washing substitute processing steps wherein the processing tanks were comprised of two tanks, three tanks, four tanks, five tanks, six tanks and nine tanks, respectively.

After the continuous processing, the spectral reflection density (640 nm) was measured on the white ground of unexposed portion for each sample. Results are shown in Table 4.

Tank solution and replenishing solution for the water-washing substitute stabilizing solution:

| | |
|---|---|
| (Solution for comparison) | |
| 1-Hydroxyethylidene-1,1-diphosphonic acid | 2 g |
| Ammonia water (25%) | 2 g |
| 5-Chloro-2-methyl-4-isothiazolin-3-on | 0.005 g |
| 2-Methyl-4-isothiazolin-3-on | 0.005 g |
| Made up to one liter by adding water, and adjusted to pH 10.70 by adding $H_2SO_4$ and KOH. | |
| (Solution of the invention) | |
| 1-Hydroxyethylidene-1,1-diphosphonic acid | 1 g |
| Ethylenediaminetetraacetic acid | 1 g |
| Ammonia water (25%) | 2 g |
| 5-Chloro-2-methyl-4-isothiazolin-3-on | 0.005 g |
| 2-Methyl-4-isothiazolin-3-on | 0.005 g |
| Made up to one liter by adding water and adjusted to pH 10.70 by using $H_2SO_4$ and KOH. | |

TABLE 4

| Water-washing substitute solution | Number of tanks for water-washing substitute solution | | | | | |
|---|---|---|---|---|---|---|
| | 2 | 3 | 4 | 5 | 6 | 9 |
| Comparison: | 0.142 | 0.129 | 0.121 | 0.111 | 0.108 | 0.108 |
| Present invention: | 0.115 | 0.110 | 0.109 | 0.108 | 0.108 | 0.108 |

As will be seen from Table 4, the effect of the invention is observed when the processing is constituted of four tanks, and is particularly remarkable when it is constituted of three or less tanks.

EXAMPLE 4

Light-sensitive materials were prepared for those in which the sensitizing dye in the fifth layer of the light-sensitive material used in Example 1 was replaced by the aforementioned Exemplary Compound I-15 or II-17, and those in which no sensitizing dye was added, both of which were prepared by coating the fifty layer emulsion directly and thereafter coating the sixth layer emulsion without coating the first to fourth layer emulsions, to have none of the first to fourth layers provided with. Similarly, light-sensitive materials were prepared, in which the coating amount for the fifth layer was made twice, three times, four times, five times, six times or seven times. Dried layer thickness of these light-sensitive materials are shown in Table 5.

Continuous processing was carried out on each of the above light-sensitive materials in the same manner as in Example 1 (except that the number of tanks for the water-washing substitute stabilizing solution was changed to 3), and, after the processing, the spectral reflection density (640 nm) on the white ground was measured. Results are shown in Table 5.

TABLE 5

| Senstizing dye in light-sensitive material | Water-washing substitute stabilizing solution | Coating amount of the fifth layer, and dried layer thickness | | | | | | |
|---|---|---|---|---|---|---|---|---|
| | | once 4.4 | twice 7.2 | 3 times 10.5 | 4 times 13.6 | 5 times 16.8 | 6 times 19.7 | 7 times 23.0 (μm) |
| None | Comparison | 0.110 | 0.114 | 0.116 | 0.118 | 0.119 | 0.120 | 0.123 |
| | Present invention | 0.108 | 0.108 | 0.109 | 0.109 | 0.109 | 0.111 | 0.116 |
| I - 15 | Comparison | 0.114 | 0.127 | 0.134 | 0.138 | 0.142 | 0.149 | 0.151 |
| | Present invention | 0.108 | 0.109 | 0.111 | 0.114 | 0.118 | 0.122 | 0.138 |
| II - 17 | Comparison | 0.113 | 0.125 | 0.133 | 0.135 | 0.146 | 0.146 | 0.149 |
| | Present invention | 0.107 | 0.109 | 0.110 | 0.112 | 0.116 | 0.119 | 0.137 |

As will be seen from Table 5, this invention is particularly effective when the dried layer thickness of the light-sensitive material is in the range of from 5 to 20 μm. Also, the effect of the invention is particularly remarkable when the light-sensitive material containing the sensitizing dye represented by the aforementioned Formula (III) or (IV).

Effect of the invention:

In the method of color developing a light-sensitive material, thereafter processing it with a processing solution having fixing ability, and subsequently processing it with a water-washing substitute stabilizing solution in a processing tank or tanks comprising 1 to 4 tanks substantially without carrying out any water-washing, cyan stains at an unexposed portion, deterioration of a water-washing substitute stabilizing solution by oxidation in air, bacteria or the like can be effectively prevented by having the water-washing substitute stabilizing solution contain the compound represented by the aforementioned Formula (I) and at least one of the nitrilotriacetic acid and the compound represented by the aforementioned Formula (II).

Also, the above effect can be enhanced by further ading $10^{-3}$ mole or more of a quarternary ammonium salt to one liter of the water-washing substitute stabilizing solution constituted as described above.

What is claimed is:

1. In a method of processing a light-sensitive silver halide color photographic material, comprising color developing a light-sensitive silver halide color photographic material and thereafter processing it with a processing solution having fixing ability, followed by processing with a water-washing substitute stabilizing solution in a processing tank or tanks comprising 1 to 4 tanks, the improvement wherein said water-washing substitute stabilizing solution contains 0.5g to 50 g per liter of at least one of the compounds represented by Formula (I) shown below and 0.5g to 50g per liter of at least one of nitrilotriacetic acid and the compounds represented by Formula (II) shown below and wherein said light-sensitive silver halide color photographic material is sensitized with an effective amount for sensitizing said photographic material of at least one sensitizing dye represented by Formula (III) or Formula (IV) shown below:

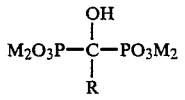

Formula (I)

wherein R represents a hydrogen atom or an alkyl group having 1 to 5 carbon atoms, and M represents a hydrogen atom or an alkali metal atom;

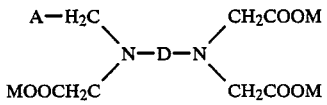

Formula (II)

wherein A represents a carboxyl group or a hydroxymethyl group; D represents an alkylene group having 2 to 4 carbon atoms and having or not having a hydroxyl group, a cyclohexene group, a group of

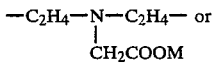

a group of $-C_2H_4OC_2H_4OC_2H_4-$; and M represents a hydrogen atom, an alkali metal atom or an ammonium group;

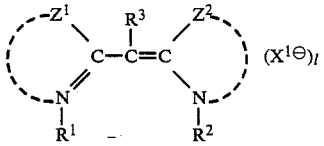

Formula (III)

wherein $Z^1$ and $Z^2$ each represent an atomic group necessary for formation of a benzothiazole nucleus, a naphthoxazole nucleus, a benzothiazole nucleus, a naphthothiazole nucleus, a benzoselenazole nucleus, a naphthoselenazole nucleus, a benzoimidazole nucleus, a naphthoimidazole nucleus, a pyridine nucleus or a quinoline nucleus; $R^1$ and $R^2$ each represent a group selected from an alkyl group, an alkenyl group and an aryl group; $R^3$ represents a hydrogen atom, a methyl group or an ethyl group; $X^{1-}$ represents an anion, and l is 0 or 1; and

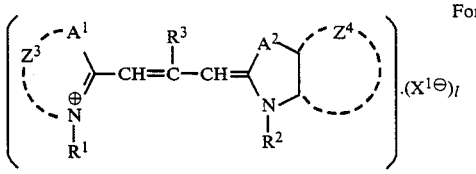

Formula (IV)

wherein $Z^3$ and $Z^4$ each represent an atomic group necessary for formation of a benzene ring or a naphthalene ring condensed at an oxazole ring or a thiazole ring, and $A^1$ and $A^2$ are each oxygen or sulfur.

2. The method of processing a light-sensitive silver, halide color photographic material according to claim 1, wherein the amount of replenishment to a processing bath using the water-washing substitute stabilizing solution is twice to 20 times of the amount of the solution carried from a bath previous to the processing bath using the water-washing substitute stabilizing solution into the processing bath using the water-washing substitute stabilizing solution, based on calculation per unit area of the light-sensitive material to be processed.

3. The method of processing a light-sensitive silver halide color photographic material according to claim 1, wherein the compound represented by Formula (II) is selected from the group consisting of ethylenediaminetetraacetic acid, N-hydroxyethyl ethylenediaminetriacetic acid, 2-hydroxy-1,3-diaminopropanetetraacetic acid, 1,2-diaminopropanetetraacetic acid, and alkali metal salts or ammonium salts of these.

4. The method of processing a light-sensitive silver halide color photographic material according to claim 1, wherein said water-washing substitute stabilizing solution has the pH of from 3.0 to 11.0.

5. The method of processing a light-sensitive silver halide color photographic material according to claim 1, wherein the compounds represented by Formula (I) is selected from the group consisting of 1-hydroxyethylidene-1,1-diphosphonic acid, 1-hydroxypropylidene-1,1-diphosphonic acid and 1-hydroxy-1,1-diphosphonomethane.

6. The method of processing a light-sensitive silver halide color photographic material according to claim 1 wherein $R^3$ is hydrogen.

7. The method of processing a light-sensitive silver halide color photographic material according to claim 1 wherein $Z^3$ and $Z^4$ are each a thiazole ring condensed at an oxazole ring.

8. The method of processing a light-sensitive silver halide color photographic material according to claim 2, wherein the compound represented by Formula (II) is selected from the group consisting of ethylenediaminetetraacetic acid, N-hydroxyethyl ethylenediaminetriacetic acid, 2-hydroxy-1,3-diaminopropanetetraacetic acid, 1,2-diaminopropanetetraacetic acid, and alkali metal salts or ammonium salts of these.

9. The method of processing a light-sensitive silver halide color photographic material according to claim 8, wherein said water-washing substitute stabilizing solution has the pH of from 3.0 to 11.0.

10. The method of processing a light-sensitive silver halide color photographic material according to claim 9, wherein the compounds represented by Formula (I) is selected from the group consisting of 1-hydroxyethylidene-1,1-diphosphonic acid, 1-hydroxypropylidene-1,1-diphosphonic acid and 1-hydroxy-1,1-diphosphonomethane.

11. The method of processing a light-sensitive silver halide color photographic material according to claim 7 wherein $R^1$ and $R^2$ are each a $C_1$–$C_4$ sulphoalkyl.

12. The method of processing a light-sensitive silver halide color photographic material according to claim 1, wherein $R^1$ and $R^2$ are each an alkyl group substituted with a carboxyl group or a sulfo group, $R^3$ is a hydrogen atom or an alkyl group having 1 to 3 carbon atoms; $Z^3$ and $Z^4$ are each a benzene ring or a thiazole ring condensed at an oxazole ring, and at least one benzene ring of these benzene rings is substituted on the 5-position with a phenyl group or one of the benzene rings is substituted with a phenyl group and the other benzene ring is substituted on the 5-position with a halogen atom.

13. The method of processing a light-sensitive siliver halide color photographic material according to claim 1 wherein $R^3$ is ethyl.

14. The method of processing a light-sensitive silver halide color photographic material according to claim 10, wherein said sensitizing dye represented by the Formula (III) or Formula (IV) is selected from the group consisting of
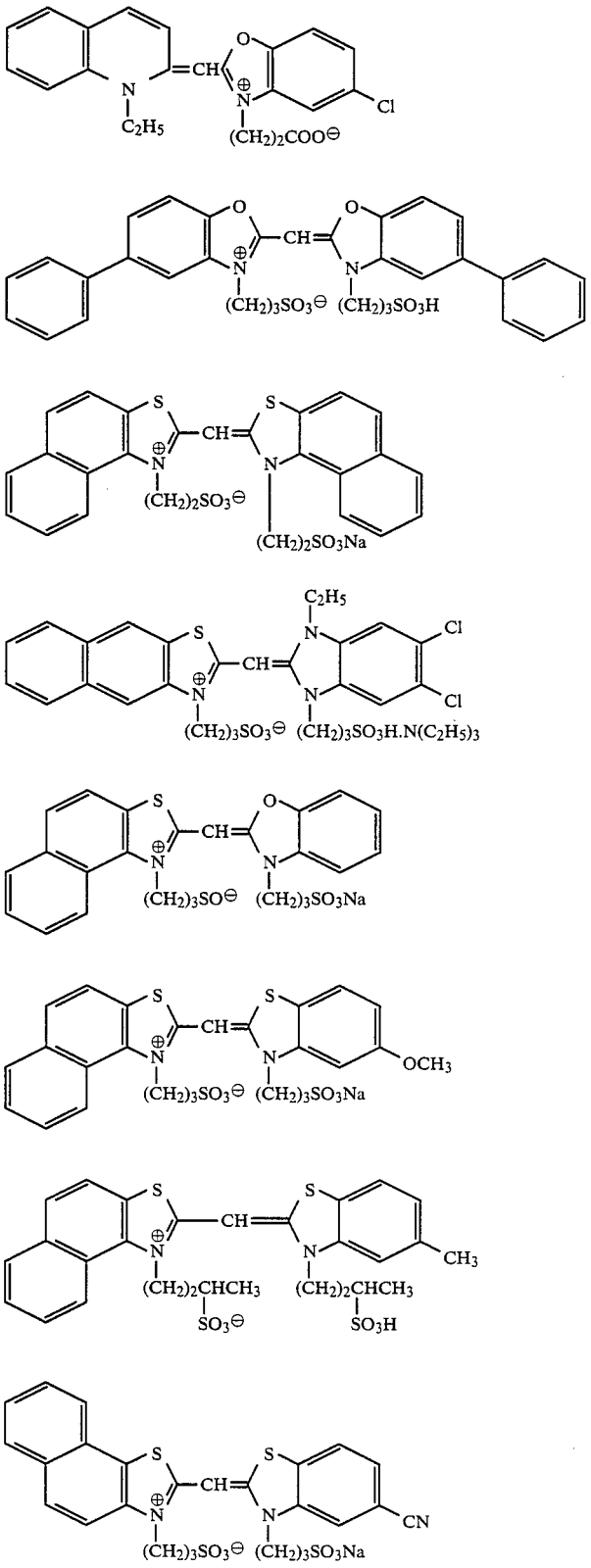

-continued
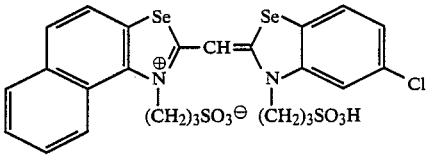
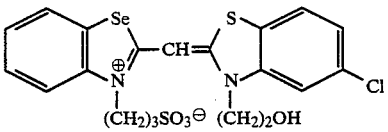
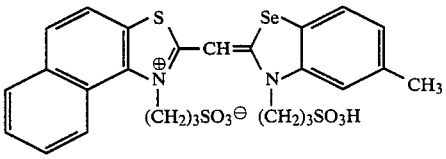
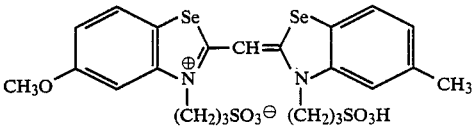
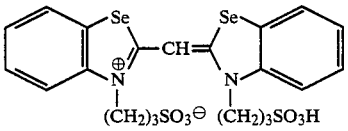
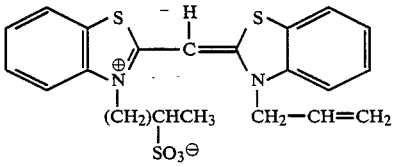
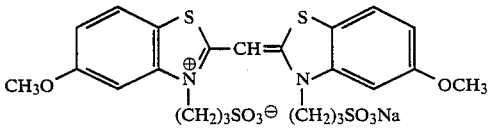
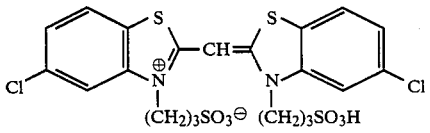
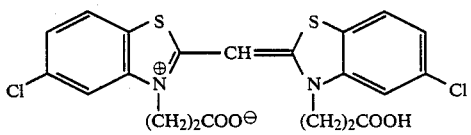
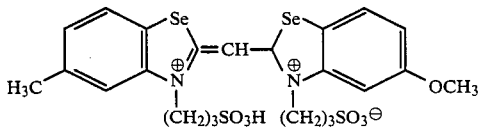

-continued
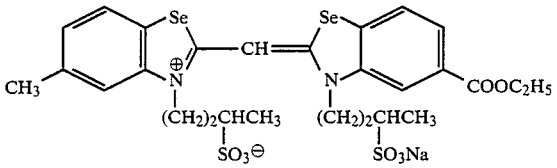
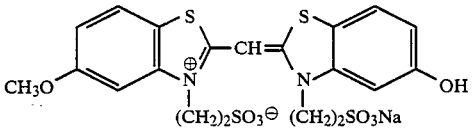
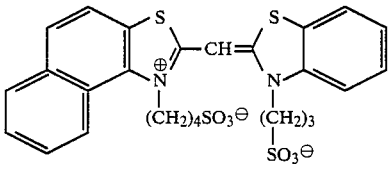
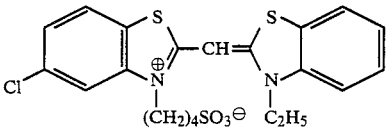
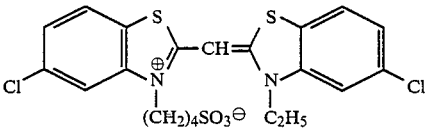
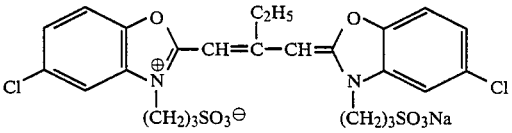
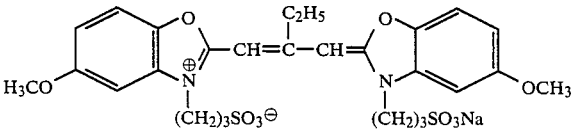
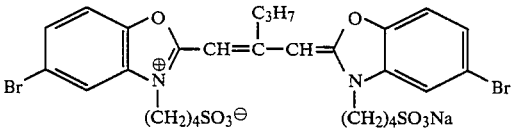
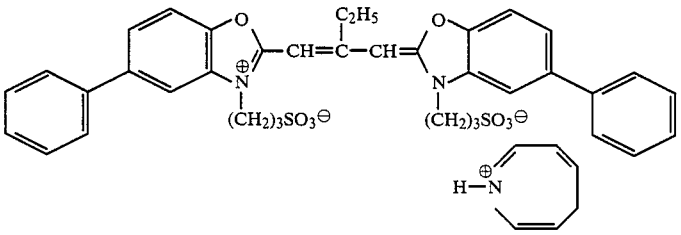

-continued
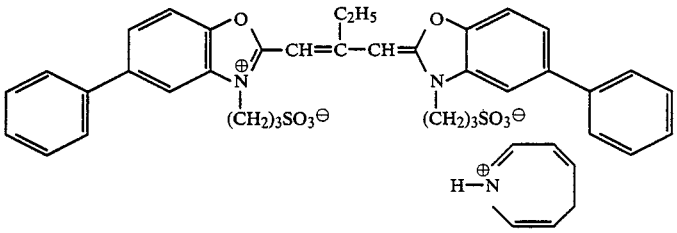
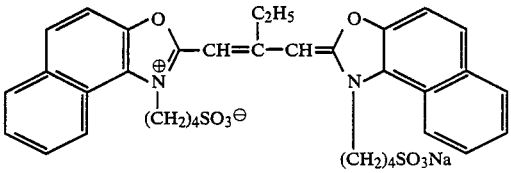
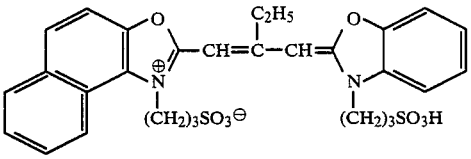
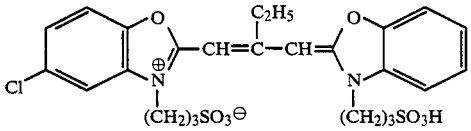
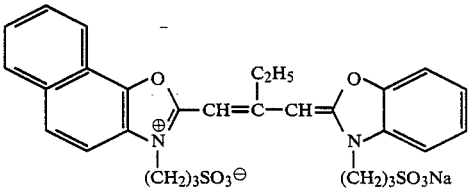
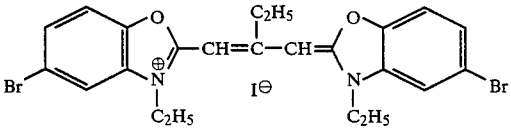
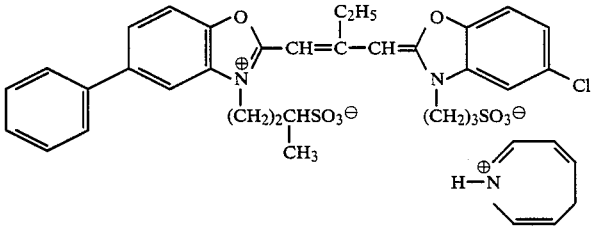
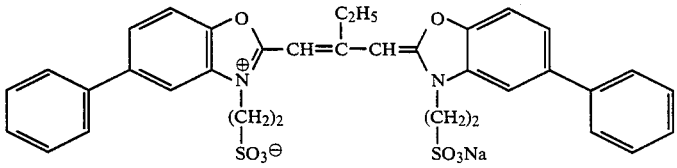

-continued

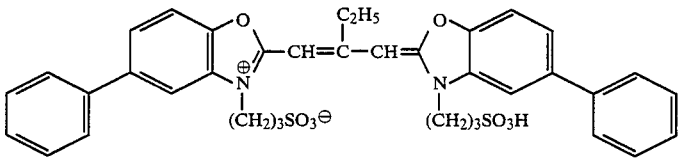

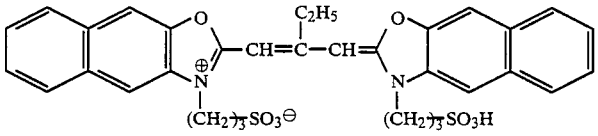

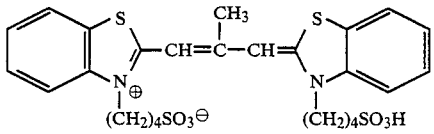

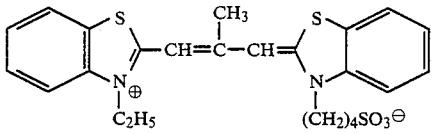

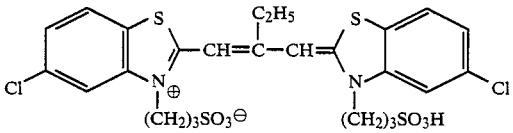

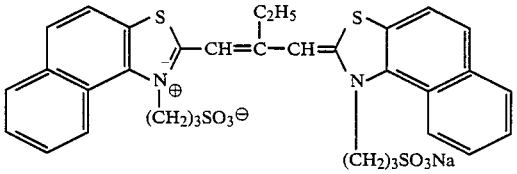

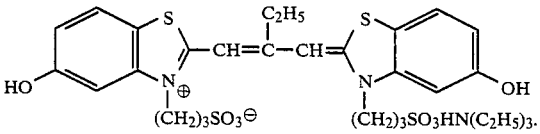

15. The method of processing a light-sensitive silver halide color photographic material according to claim 1 wherein $Z^3$ and $Z^4$ are each a benzene ring or a thiazole ring condensed at the oxazole ring, and one of the benzene rings is substituted with a phenyl group and the other benzene ring is substituted on the 5-position with a halogen atom.

16. The method of processing a light-sensitive silver halide color photographic material according to claim 15 wherein $R^1$ and $R^2$ are each a $C_1$–$C_4$ sulphoalkyl.

17. The method of processing a light-sensitive silver halide color photographic material according to claim 1 wherein $Z^3$ and $Z^4$ are each a benzene ring with at least one benzene ring being substituted at the 5-position with a phenyl group.

18. The method of processing a light-sensitive silver halide color photographic material according to claim 17 wherein $R^1$ and $R^2$ are each a $C_1$–$C_4$ sulphoalkyl.

* * * * *

UNITED STATES PATENT AND TRADEMARK OFFICE

CERTIFICATE OF CORRECTION

PATENT NO. : 4,863,837

DATED : September 5, 1989

INVENTOR(S) : KUREMATSU et al

It is certified that error appears in the above-identified patent and that said Letters Patent is hereby corrected as shown below:

Title page, Abstract, right column, insert above last formula: --Formula (IV)--.

Column 28, line 61 (Claim 1): Replace "0.5g to 50 g" with --0.05 g to 50 g--.

Column 28, line 63 (Claim 1): Replace"0.5g to 50g" with --0.05 g to 50 g--.

Signed and Sealed this

Fourteenth Day of May, 1991

*Attest:*

HARRY F. MANBECK, JR.

*Attesting Officer*

*Commissioner of Patents and Trademarks*